US008405476B2

(12) United States Patent
Wu

(10) Patent No.: US 8,405,476 B2
(45) Date of Patent: Mar. 26, 2013

(54) RELAY WITH MULTIPLE CONTACTS

(75) Inventor: Sung Jen Wu, Taipei County (TW)

(73) Assignee: Song Chuan Precision Co., Ltd., Taipei County (TW)

( * ) Notice: Subject to any disclaimer, the term of this patent is extended or adjusted under 35 U.S.C. 154(b) by 0 days.

(21) Appl. No.: 13/014,096

(22) Filed: Jan. 26, 2011

(65) Prior Publication Data

US 2012/0188032 A1 Jul. 26, 2012

(51) Int. Cl.
*H01H 67/02* (2006.01)

(52) U.S. Cl. ..... 335/131; 335/78; 335/128

(58) Field of Classification Search ..... 335/78, 335/128–132
See application file for complete search history.

(56) References Cited

U.S. PATENT DOCUMENTS

| | | | | |
|---|---|---|---|---|
| 6,424,243 | B1 * | 7/2002 | Forster | 335/132 |
| 6,693,248 | B1 * | 2/2004 | Schultz | 200/11 TC |
| 2003/0210117 | A1 * | 11/2003 | Arnholt | 335/132 |
| 2009/0219119 | A1 * | 9/2009 | Lefebvre | 335/202 |

* cited by examiner

*Primary Examiner* — Bernard Rojas

(57) ABSTRACT

A relay with multiple contacts includes a coil assembly and a contact assembly. The contact assembly includes at least one base having at least two slots defined therein and at least two bridge members respectively received in the at least two slots. Each bridge member has at least two terminal portions respectively formed thereon. Each terminal portion has a movable contact mounted thereon. At least one connector has at least two fixed contacts mounted thereon. Each fixed contact selectively connects with the corresponding movable contact. A first conducting member and a second conducting member are located between the coil assembly and the contact assembly. The first conducting member has at least one first fixed contact for selectively connecting with the corresponding movable contact. The second conducting member has at least one second fixed contact for selectively connecting with the corresponding movable contact.

6 Claims, 11 Drawing Sheets

RELAY WITH MULTIPLE CONTACTS

BACKGROUND OF THE INVENTION

1. Field of the Invention

The present invention relates to a relay with multiple contacts, and more particularly to a relay having multiple contacts disposed thereon for suppressing electric arc across two contacts.

2. Description of Related Art

A relay is an electrically operated switch for controlling a circuit by applying a low electric current. The most common types of relays used are electromechanical relays, reed relays, and solid state relays, etc. Generally, when electric current flows through the conventional relay, an electric arc is generated between two leads of the switch which are disposed in a distance. If a circuit has enough electric current and voltage to sustain an electric arc formed outside of an electrical device, the electric arc can cause damage to electric device such as melting of conductors, destruction of insulation, and fire. In order to eliminating the electric arcing, capacitors in parallel and resistor, capacitor in series, or increasing the distance of the two contacts/leads are applied in an arc protection circuit.

Nowadays, a small-scale conventional relay is designed for a small-scale electric device. It is difficult to apply the increased distance between two contacts/leads in the small-scale device for reducing the electric arcing. And if the distance between two contacts/leads is increased, the conventional relay may cause the contact fault and the electric circuit of the relay may not be accurate.

The present invention has arisen to mitigate and/or obviate the disadvantages of the conventional relays.

SUMMARY OF THE INVENTION

The main objective of the present invention is to provide an improved relay with multiple contacts for suppressing electric arc across any two contacts.

To achieve the objective, the relay with multiple contacts in accordance with the present invention includes a coil assembly, a contact assembly, a first conducting member, and a second conducting member. The coil assembly comprises a housing for receiving the coil assembly, the contact assembly, the first conducting member, and the second conducting member. The coil assembly has at least one iron core received in the housing, at least one coil sleeving on the at least one iron core, at least one magnetic member dispose above the at least one coil, and at least one spring disposed between the at least one magnetic member and the at least one coil. The at least one spring has two ends respectively abutting against the at least one magnetic member and the at least one coil.

The contact assembly is disposed adjacent to the coil assembly and comprises at least one base mounted on a top of the at least one magnetic member. The at least one base has at least two slots defined therein and laterally extending therethrough. The at least one base has at least two bores defined therein and communicating with the at least two slots. At least two bridge members are respectively received in the at least two slots. Each bridge member has at least two terminal portions respectively formed on two opposite ends and extending from the corresponding slot. Each terminal portion of the at least two bridge members is bent into a L shape and has a movable contact electrically mounted thereon. Each bridge member has at least one through hole defined therein and communicating with the corresponding bore, such that the at least two bridge members are able to rivet to the base or to connect with the base by heat staking. Or the at least two bridge members are respectively enclosed within the at least two slots of the at least one base during injection molding. At least one connector is disposed adjacent to one side of the base and has at least two fixed contacts electrically mounted thereon. Each fixed contact selectively and electrically connecting with the corresponding movable contact of the at least two bridge members. At least two shunts are respectively disposed on the at least two bridge members. Each shunt has two ends electrically connected with the at least two terminal portions of each bridge member, such that the at least two shunt and the at least two bridge members are arranged in a parallel connection.

The first conducting member and the second conducting member are disposed adjacent to the other side of the base which is opposite to the at least one connector and are located between the coil assembly and the contact assembly. The first conducting member has at least one first fixed contact mounted thereon for selectively and electrically connecting with the movable contact of the corresponding bridge member. The second conducting member has at least one second fixed contact mounted thereon for selectively and electrically connecting with the movable contact of the corresponding bridge member.

Additionally, when the at least one coil induces a magnetic field by supplying electric current, the at least one magnetic member is magnetically attracted to move toward the at least one coil. The at least one base, the at least two bridge members, and the at least two shunts are moved with the at least one magnetic member. The at least one spring is compressed by the at least one magnetic member. The movable contacts of the at least two bridge members correspondingly and respectively move to electrically contact with the at least one first fixed contact, the at least one second fixed contact, and the at least two fixed contacts for adapting to open a circuit; when no electricity is supplied to the at least one coil, the at least one spring forces to restore the at least one magnetic member. The magnetic member moves the at least one base, the at least two bridge members, the at least two shunts backwardly for closing the circuit.

In accordance with another aspect of the present invention, each end of the at least two bridge members has two terminal portions formed thereon. Each terminal portion has a movable contact electrically mounted thereon. The at least one connector has four fixed contacts mounted thereon for corresponding to the movable contacts. The first conducting member has two first fixed contacts mounted thereon for selectively contacting with the corresponding movable contacts. The second conducting member has two second fixed contacts mounted thereon for selectively contacting with the corresponding movable contacts.

Further benefits and advantages of the present invention will become apparent after a careful reading of the detailed description with appropriate reference to the accompanying drawings.

DETAILED DESCRIPTION OF THE INVENTION

Figure 1:
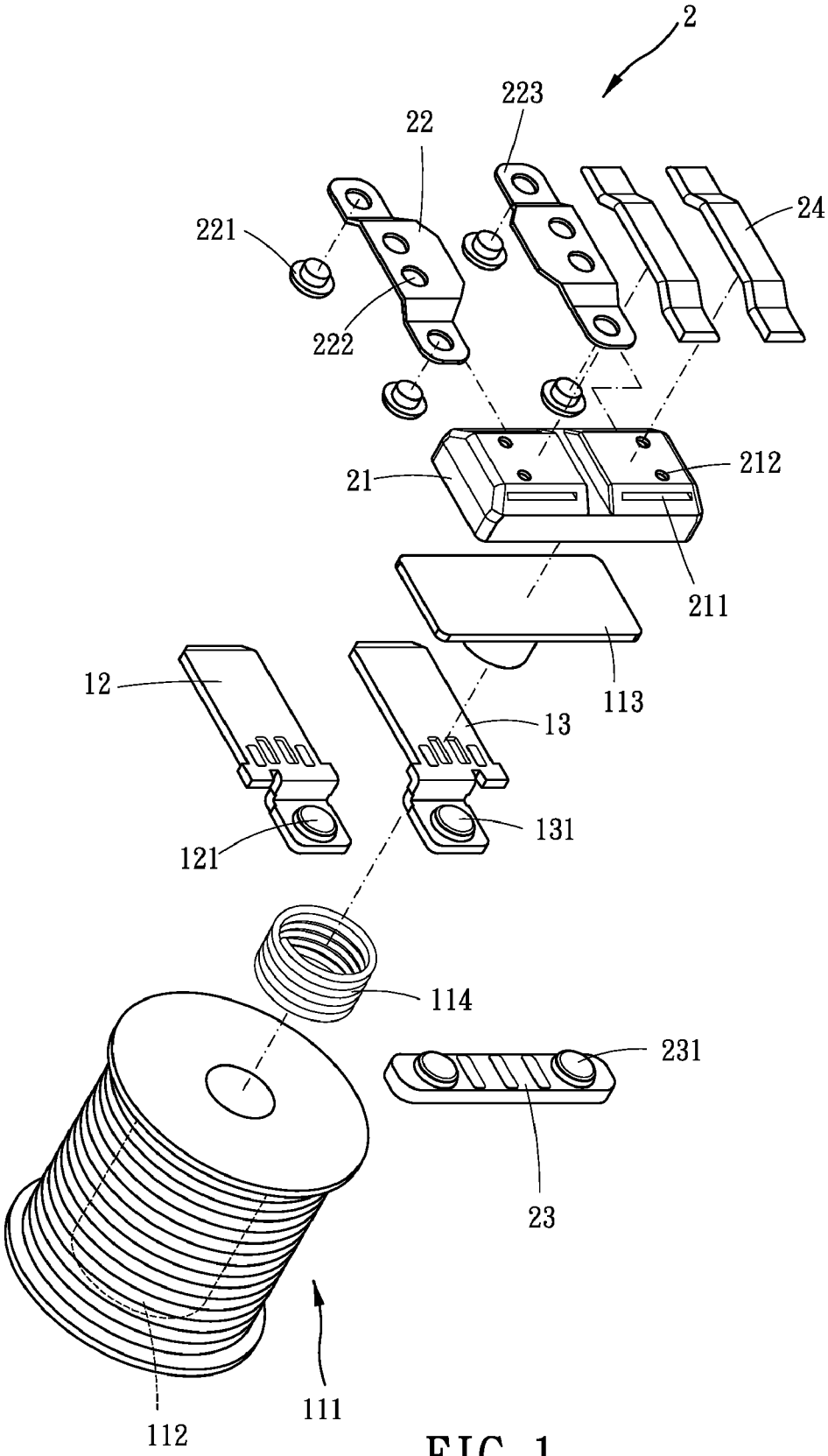
FIG. 1 is a partially exploded perspective view of a preferred embodiment of a relay with multiple contacts in accordance with the present invention.
Figure 2:
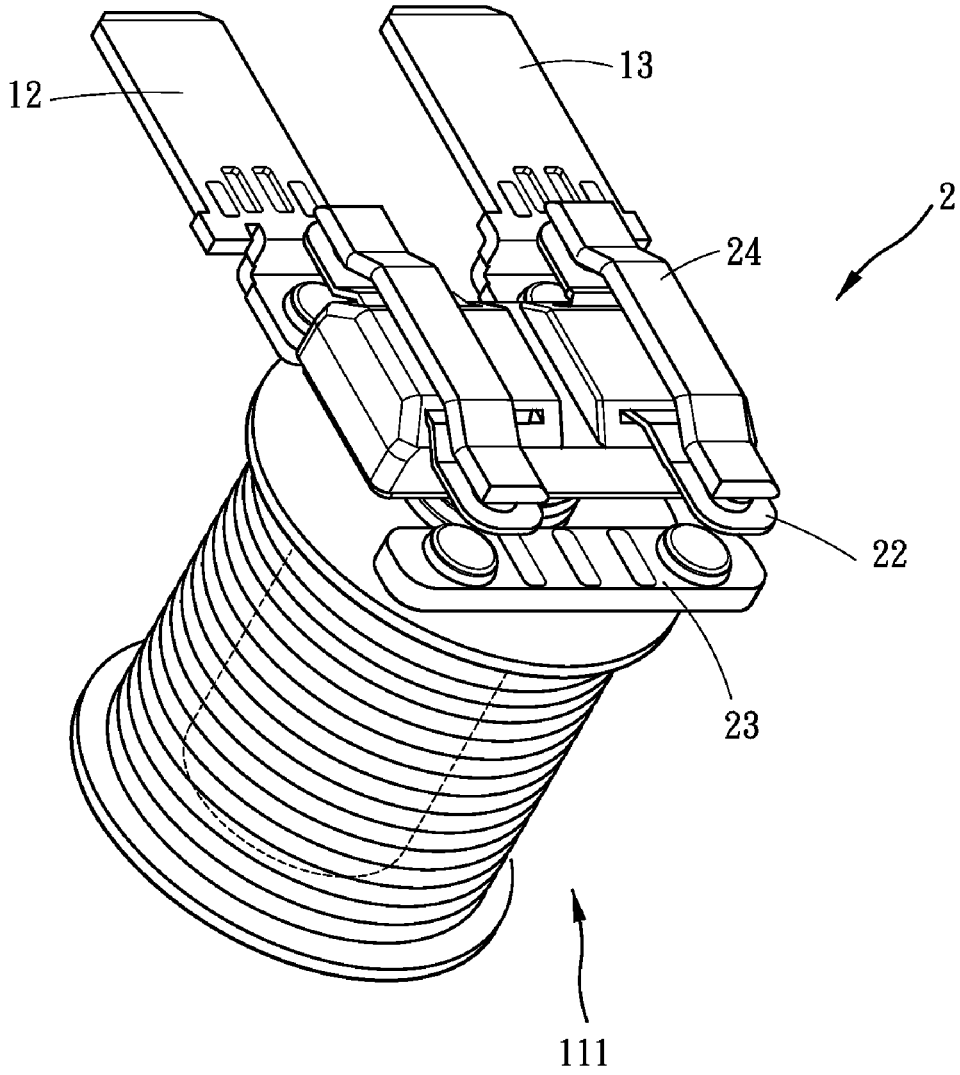
FIG. 2 is an assembled perspective view of the preferred embodiment of the relay with multiple contacts in accordance with the present invention.

Referring to the drawings and initially to FIGS. 1-5, a relay with multiple contacts in accordance with a preferred embodiment of the present invention comprises a coil assembly 11, a contact assembly 2, a first conducting member 12, and a second conducting member 13. The coil assembly comprises a housing 1 for receiving the coil assembly 11, the contact assembly 2, the first conducting member 12, and the second conducting member 13. The coil assembly 11 has an iron core 112 received in the housing 1, a coil 111 sleeving on the iron core 112, a magnetic member 113 dispose above the coil 111, and a coil spring 114 disposed between the magnetic member 113 and the coil 111. The magnetic member 113 has a plate portion (not numbered) and a rod portion (not numbered) axially disposed on a bottom of the plate portion. The coil spring 114 sleeves on the rod portion of the magnetic member 113 and has two ends respectively abutting against the bottom of the plate portion and a top of the coil 111.

The contact assembly 2 is disposed adjacent the coil assembly 11 and comprises a base 21 mounted on a top of the plate portion of the magnetic member 113. The base 21 has two slots 211 defined therein and laterally extending therethrough. The base 21 has four bores 212 defined in a top thereof. Two of the bores 212 communicate with one slot 211 and the other two bores 212 communicate with the other slot 211. Two bridge members 22 are respectively received in the two slots 211. Each bridge member 22 has two terminal portions 223 respectively formed on two opposite ends and extending from the corresponding slot 211. Each terminal portion 223 of the two bridge members 22 is bent into a L shape and has a movable contact 221 electrically mounted thereon. Each bridge member 22 has two through holes 222 defined therein and communicating with the two corresponding bores 212, such that the two bridge members 22 are able to rivet to the base 21 or to connect with the base 21 by heat staking. Or the two bridge members 22 are respectively enclosed within the two slots 211 of the base 21 during injection molding.

A connector 23 is disposed adjacent to one lateral side of the base 21 and has two fixed contacts 231 electrically mounted on two ends thereof for corresponding to the two movable contacts 221 which are located at the same lateral side of the base 21. Each fixed contact 231 selectively and electrically connecting with the corresponding movable contact 221 of the two bridge members 22. Two shunts 24 are disposed on the top of the base 21 and respectively connected with the two bridge members 22. Each shunt 24 has two ends electrically connected with the corresponding movable contacts 221 of the two terminal portions 223 of each bridge member 22, such that the two shunt 24 and the two bridge members 22 are arranged in a parallel connection.

The first conducting member 12 and the second conducting member 13 are both disposed adjacent to the other lateral side of the base 21 which is opposite to the connector 23 and are located between the coil assembly 11 and the contact assembly 2. The first conducting member 12 has a first fixed contact 121 mounted on one end thereof for selectively and electrically connecting with the movable contact 221 of the corresponding bridge member 22. The second conducting member 13 has a second fixed contact 131 mounted on one end thereof for selectively and electrically connecting with the movable contact 221 of the corresponding bridge member 22.

Figure 3:
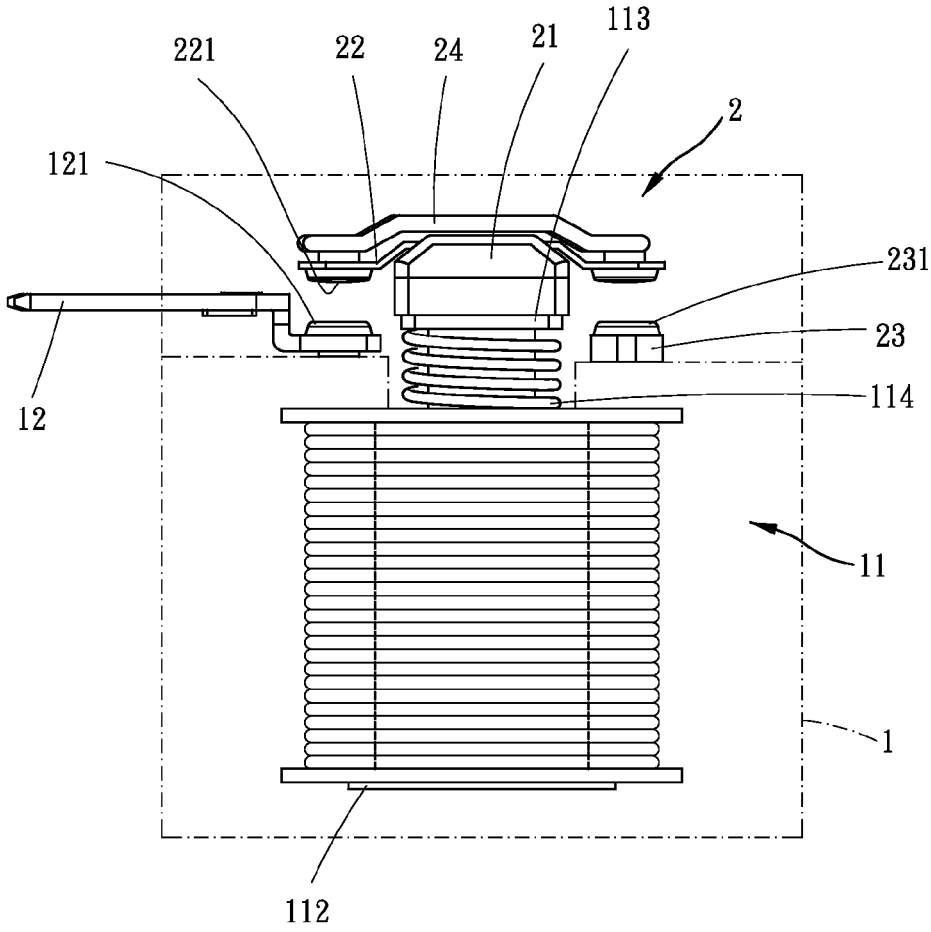
FIGS. 3-4 are operational cross sectional views of the preferred embodiment of the relay with multiple contacts in accordance with the present invention.
Figure 4:
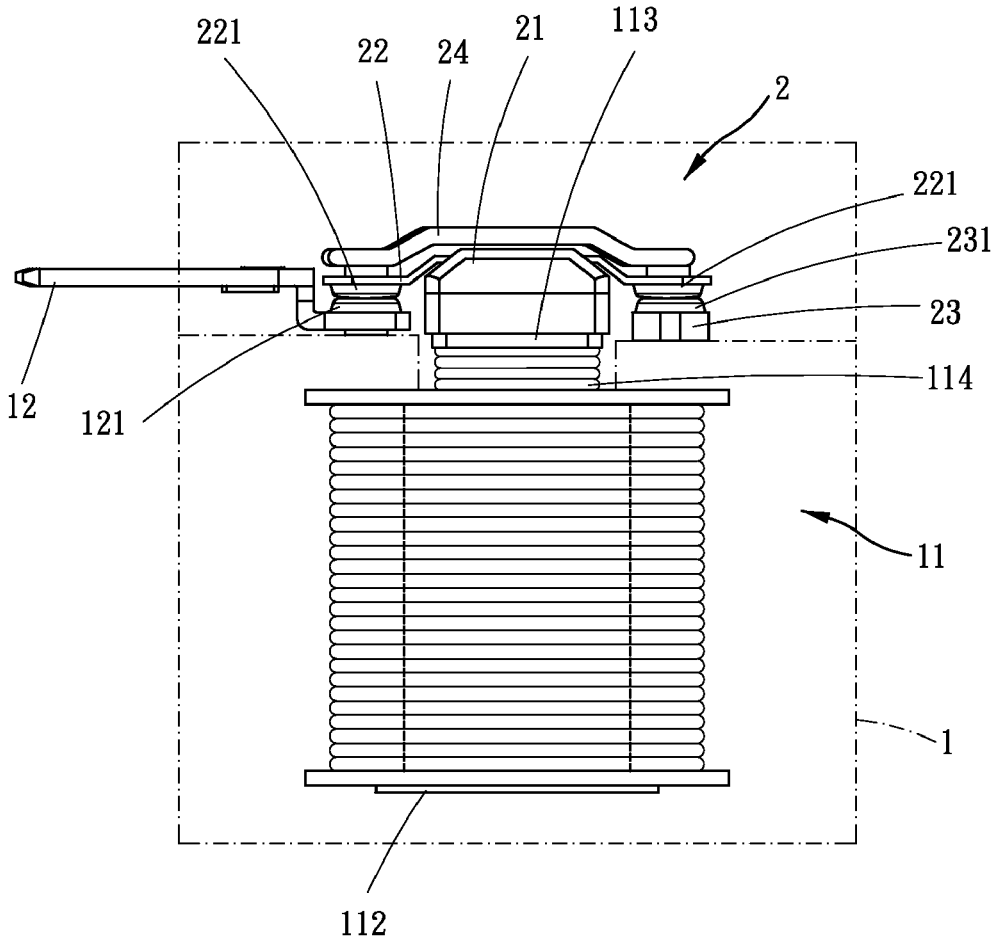
Figure 5:
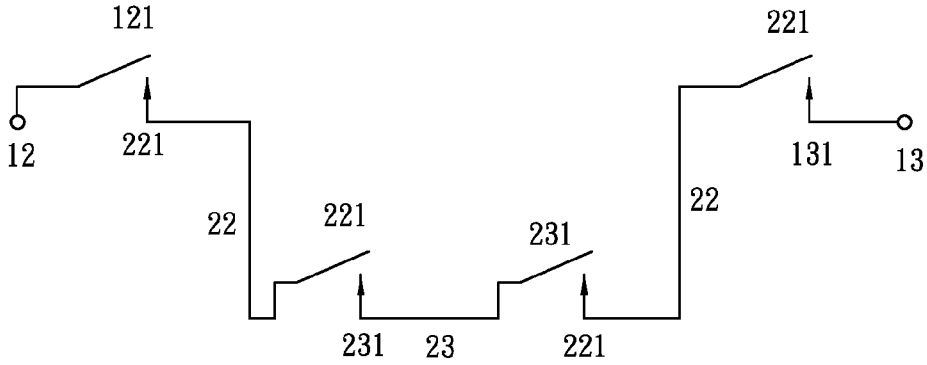
FIG. 5 is a circuit diagram of the preferred embodiment of the relay with multiple contacts in accordance with the present invention.

The operation of the relay with multiple contacts in accordance with the present invention will be described in detailed below. As shown in FIGS. 3-4, when the coil 111 induces a magnetic field by supplying electric current, the magnetic member 113 is magnetically attracted to move toward the coil 111. The base 21, the two bridge members 22, and the two shunts 24 are simultaneously moved with the magnetic member 113. The coil spring 114 is compressed by the magnetic member 113. The movable contacts 221 of the two bridge members 22 correspondingly and respectively move to electrically contact with the first fixed contact 121, the second fixed contact 131, and the two fixed contacts 231 for opening a circuit.

When no electric current is supplied to the coil 111 and the magnetic field is disappeared, the coil spring 114 forces to restore the magnetic member 113. The magnetic member 113 moves the base 21, the two bridge members 22, and the two shunts 24 away from the coil 111 for closing the circuit.

Figure 6:
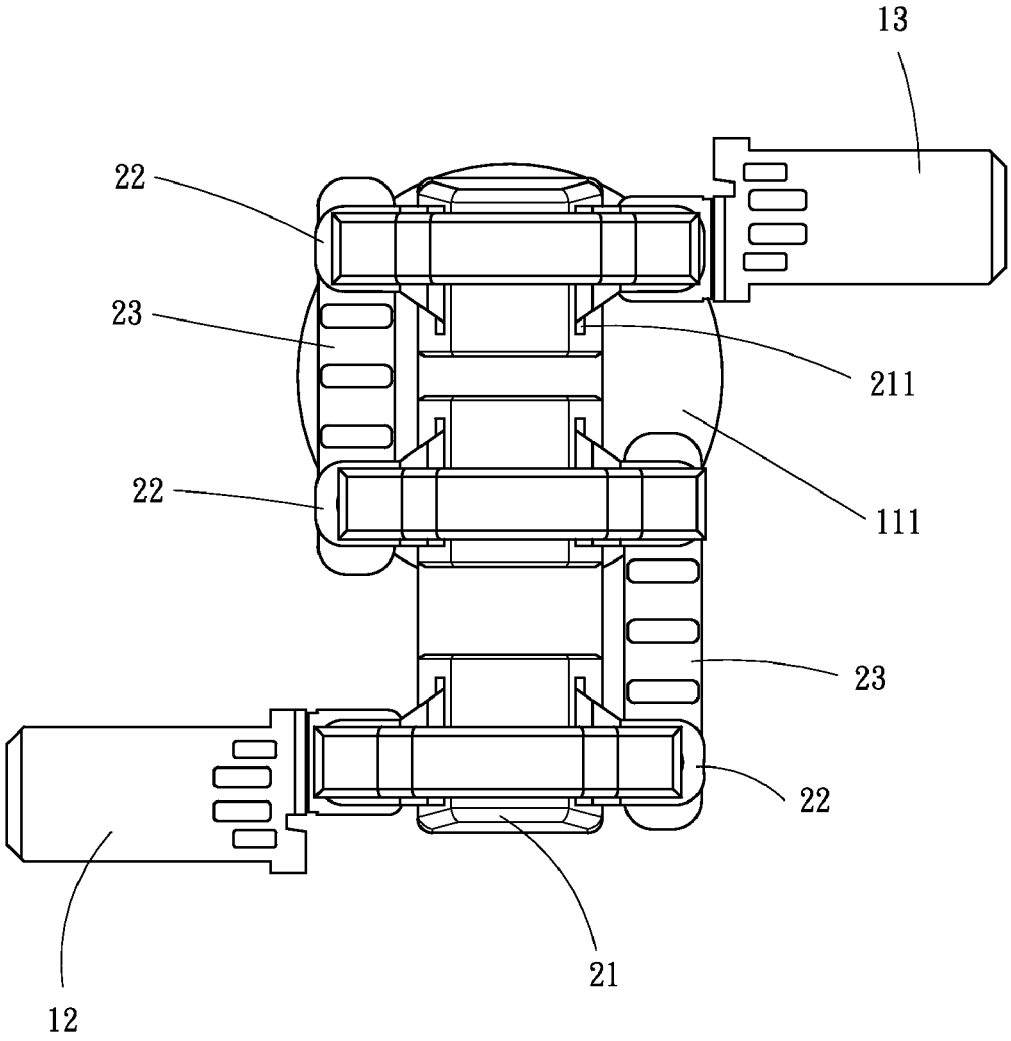
FIG. 6 is an assembled plane view of a second embodiment of the relay with multiple contacts in accordance with the present invention.
Figure 7:
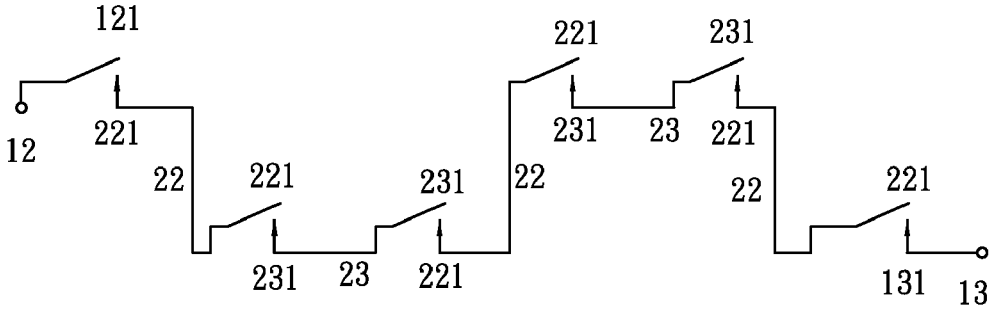
FIG. 7 is a circuit diagram of the second embodiment of the relay with multiple contacts in accordance with the present invention.

With reference to FIGS. 6-7, that shows a second embodiment of the relay with multiple contacts in accordance with the present invention. The elements and effects of the third embodiment which are the same with the preferred embodiment are not described, only the differences are described. In this embodiment, the base 21 has three slots 211 parallelly defined therein and laterally extending therethrough. The contact assembly 2 has three bridge members 22 respectively received in the three slots 211 and two connectors 23 respectively disposed beside two opposite lateral sides of the base 21. The three movable contacts 221 which are located at the same lateral side of the base 21 sequentially and selectively contact with the two fixed contacts 231 of one connector 23 and the first fixed contact 121 of the first conducting member 12. The other three movable contacts 221 which are located at the opposite lateral side of the base 21 sequentially and selectively contact with the second fixed contact 131 of the second conducting member 13 and the two fixed contacts 231 of the other connector 23. Therefore, the first conducting member 12 and the second conducting member 13 are located at two opposite lateral sides of the base 21. And as shown in FIG. 7, the first conducting member 12, the second contacting member 13, the three bridge members 22, and the two connectors 23 are arranged in series with a single input and a single output.

Figure 8:
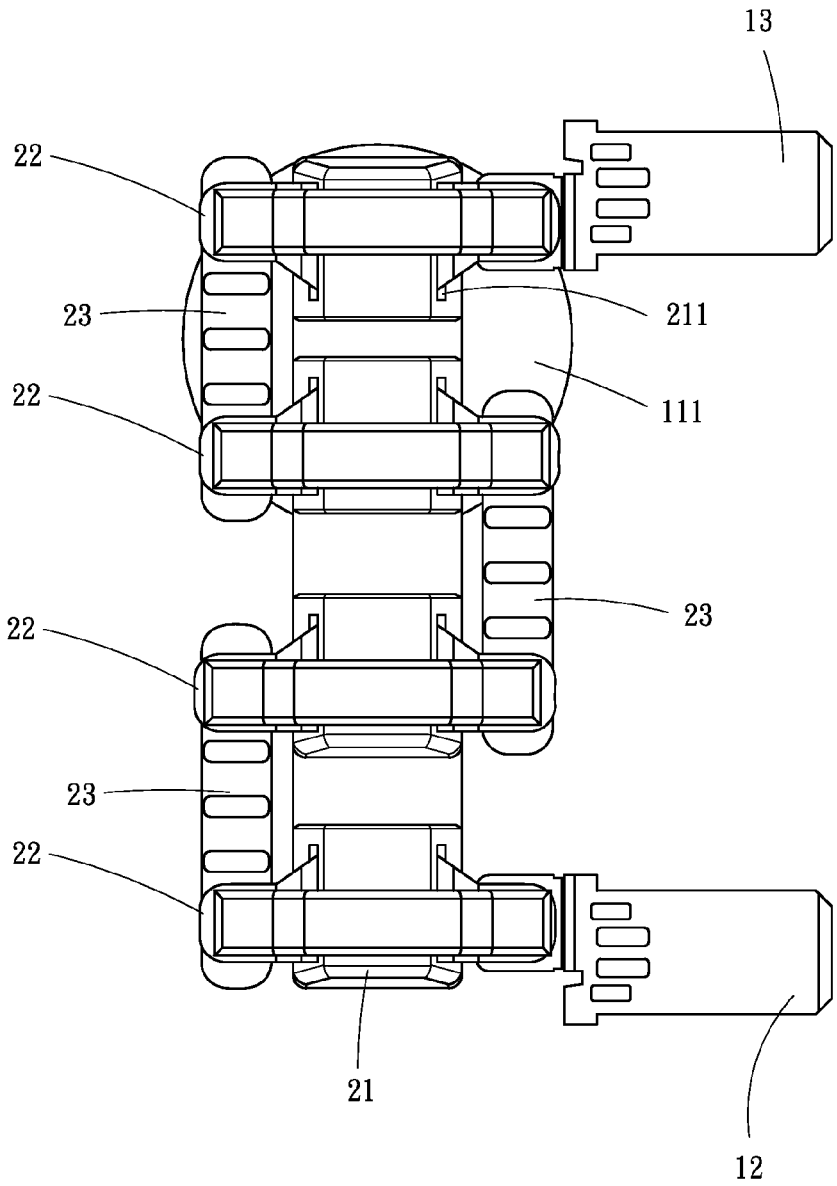
FIG. 8 is an assembled plane view of a third embodiment of the relay with multiple contacts in accordance with the present invention.
Figure 9:
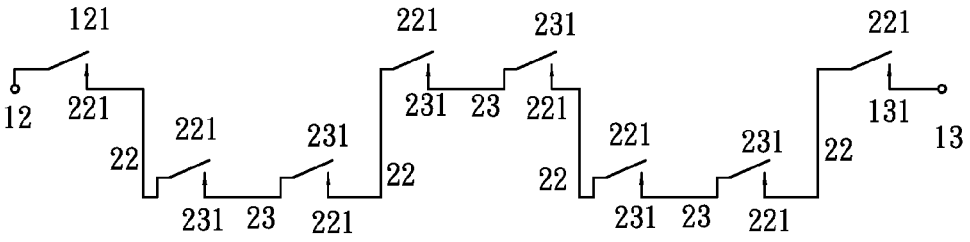
FIG. 9 is a circuit diagram of the third embodiment of the relay with multiple contacts in accordance with the present invention.

With reference to FIGS. 8-9, that shows a third embodiment of the relay with multiple contacts in accordance with the present invention. The elements and effects of the third embodiment which are the same with the preferred embodiment are not described, only the differences are described. In this embodiment, the base 21 has four slots 211 parallelly defined therein and laterally extending therethrough. The contact assembly 2 has four bridge members 22 respectively received in the four slots 211 and three connectors 23. The four movable contacts 221 which are located at the same lateral side of the base 21 sequentially and selectively contact with the first fixed contact 121, the two fixed contacts 231 of one connector 23, and the second fixed contact 131. The other four movable contacts 221 which are located at the opposite lateral side of the base 21 sequentially and selectively contact with the four fixed contacts 231 of the other two connectors 23. Therefore, the first conducting member 12 and the second conducting member 13 are located at the same lateral side of the base 21. And as shown in FIG. 9, the first conducting member 12, the second contacting member 13, the four bridge members 22, and the three connectors 23 are arranged in series with a single input and a single output.

Figure 10:
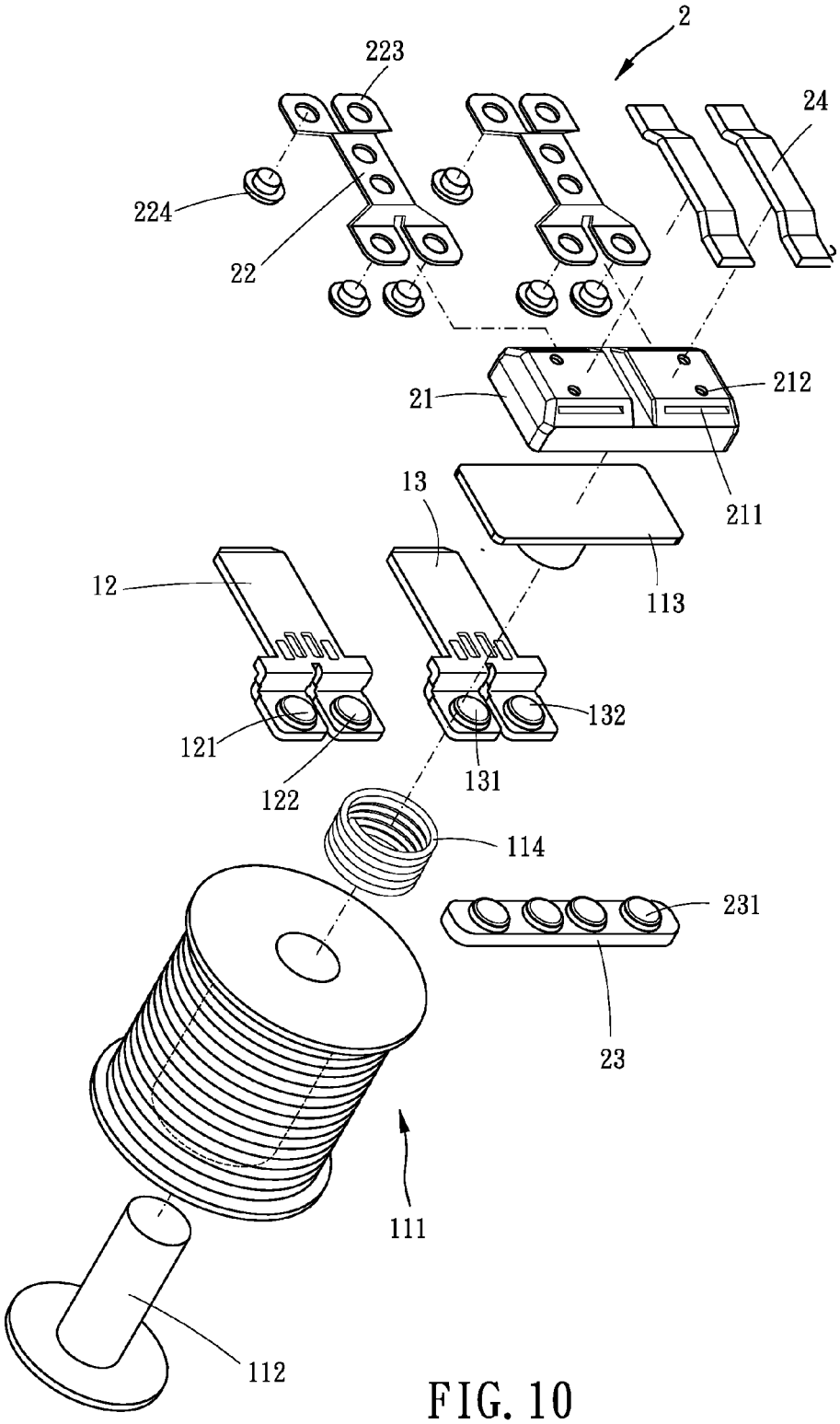
FIG. 10 is an exploded perspective view of a fourth embodiment of a relay with multiple contacts in accordance with the present invention.
Figure 11:
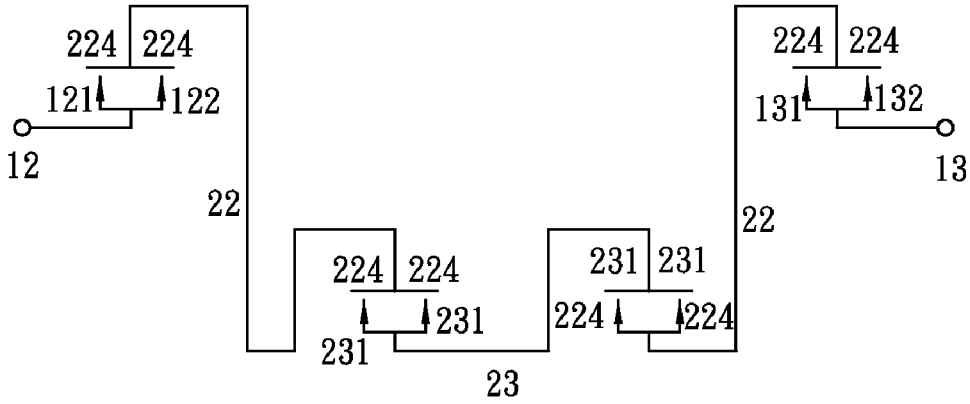
FIG. 11 is a circuit diagram of the fourth embodiment of the relay with multiple contacts in accordance with the present invention.

With reference to FIGS. 10-11, that shows a fourth embodiment of the relay with multiple contacts in accordance with the present invention. The elements and effects of the third embodiment which are the same with the preferred embodiment are not described, only the differences are described. In this embodiment, each end of the two bridge members 22 has two terminal portions 223 formed thereon. Each terminal portion 223 has a movable contact 224 electrically mounted thereon. The connector 23 has four fixed contacts 231 mounted thereon for correspondingly and selectively connecting with the four movable contacts 224 which are located at the same lateral side of the base 21. The first conducting member 12 has two first fixed contacts 121, 122 mounted thereon. The second conducting member 13 has two second fixed contacts 131, 132 mounted thereon. The other four movable contacts 224 which are located at the opposite lateral side of the base 21 correspondingly and selectively contact with the two first fixed contacts 121, 122 and the two second fixed contacts 131, 132.

Therefore, the relay with multiple contacts in accordance with the prevent invention provides an effective elimination of the electric arcing. And the parallel connection of the bridge members 22 and the shunts 24 is able to reduce the resistance and the contact voltage.

Although the invention has been explained in relation to its preferred embodiment, it is to be understood that many other possible modifications and variations can be made without departing from the spirit and scope of the invention as hereinafter claimed.

What is claimed is:

1. A relay with multiple contacts comprising:

a coil assembly;

a contact assembly disposed adjacent to the coil assembly and comprising:

at least one base having at least two slots defined therein and laterally extending therethrough;

at least two bridge members respectively received in the at least two slots and each bridge member having two terminal portions respectively formed on two opposite ends and extending from the corresponding slot, each terminal portion having a movable contact electrically mounted thereon; and at least one connector disposed adjacent to one side of the base and having at least two fixed contacts electrically mounted thereon, each fixed contact selectively and electrically connecting with the corresponding movable contact of the at least two bridge members;

a first conducting member and a second conducting member disposed adjacent to the other side of the base opposite to the at least one connector and located between the coil assembly and the contact assembly, the first conducting member having at least one first fixed contact mounted thereon for selectively and electrically connecting with the movable contact of the corresponding bridge member, the second conducting member having at least one second fixed contact mounted thereon for selectively and electrically connecting with the movable contact of the corresponding bridge member; and wherein when the coil assembly induces an magnetic field by supplying electric current, the base is magnetically attracted and moved by the magnetic field, the at least two bridge members moved with the base, the movable contacts of the at least two bridge members correspondingly and respectively move to electrically contact with the at least one first fixed contact, the at least one second fixed contact, and the at least two fixed contacts for adapting to open a circuit.

2. The relay with multiple contacts as claimed in claim 1, wherein the contact assembly comprises at least two shunts respectively disposed on the at least two bridge members, each shunt having two ends electrically connected with the at least two terminal portions of each bridge member, such that the at least two shunt and the at least two bridge members are arranged in a parallel connection.

3. The relay with multiple contacts as claimed in claim 1, wherein the at least one base has at least two bores defined therein and communicating with the at least two slots, each bridge member having at least one through hole defined therein and communicating with the corresponding bore.

4. The relay with multiple contacts as claimed in claim 1, wherein the base is formed by injection molding and the at least two bridge members are respectively enclosed within the at least two slots during injection molding.

5. The relay with multiple contacts as claimed in claim 1, wherein each terminal portion of the at least two bridge members is bent into a L shape.

6. The relay with multiple contacts as claimed in claim 1 further comprising a housing for receiving the coil assembly, the contact assembly, the first conducting member, and the second conducting member, the coil assembly comprising at least one iron core, at least one coil sleeving on the at least one iron core, at least one magnetic member mounted on a bottom of the base, and at least one spring disposed between the at least one magnetic member and the at least one coil, the at least one spring having two ends respectively abutting against the at least one magnetic member and the at least one coil, wherein when the at least one coil induces a magnetic field by supplying electric current, the at least one magnetic member is magnetically attracted to move toward the at least one coil and the at least one spring is compressed by the at least one magnetic member; when no electricity is supplied to the at least one coil, the at least one spring forces to restore the at least one magnetic member.

* * * * *